United States Patent [19]

Bammert

[11] 4,394,113

[45] Jul. 19, 1983

[54] LUBRICATION AND PACKING OF A ROTOR-TYPE COMPRESSOR

[75] Inventor: Karl Bammert, Hanover, Fed. Rep. of Germany

[73] Assignee: M.A.N. Maschinenfabrik Augsburg-Nürnberg Aktiengesellschaft, Fed. Rep. of Germany

[21] Appl. No.: 213,722

[22] Filed: Dec. 5, 1980

[30] Foreign Application Priority Data

Dec. 5, 1979 [DE] Fed. Rep. of Germany ..... 2948992

[51] Int. Cl.[3] ..... F01C 1/16

[52] U.S. Cl. ..... 418/98; 418/201

[58] Field of Search ..... 418/97, 98, 99, 100, 418/201, DIG. 1

[56] References Cited

U.S. PATENT DOCUMENTS

| | | | |
|---|---|---|---|
| 3,073,513 | 1/1963 | Bailey | 418/201 |
| 3,462,072 | 8/1969 | Schibbye | 418/99 |
| 3,556,697 | 1/1971 | Webb et al. | 418/98 |
| 3,975,123 | 8/1976 | Schibbye | 418/201 |
| 4,076,468 | 2/1978 | Persson et al. | 418/97 |
| 4,080,119 | 3/1978 | Eriksson | 418/97 |

FOREIGN PATENT DOCUMENTS

| | | | |
|---|---|---|---|
| 2008684A | 6/1979 | United Kingdom | 418/98 |

*Primary Examiner*—Charles J. Myhre
*Assistant Examiner*—Magdalen Moy
*Attorney, Agent, or Firm*—McGlew and Tuttle

[57] ABSTRACT

An improved rotor compressor, particularly a screw-type compressor, for compressing a gas is disclosed. The compressor is provided with a housing having an annular drain space surrounding rotor shafts at a location between each shaft bearing and the working space for removing escaping lubricant and gas. The drain space is connected through a drain passage to a closed collecting chamber which is substantially under the intake pressure of the compressor. A return passage is provided for returning gas to at least one of the intake and the working space of the compressor and for returning lubricant to a lubrication circuit.

10 Claims, 2 Drawing Figures

LUBRICATION AND PACKING OF A ROTOR-TYPE COMPRESSOR

FIELD AND BACKGROUND OF THE INVENTION

This invention relates to compressors in general and, in particular, to an improved screw-type compressor having a lubrication system for supplying lubricant to and draining it from shaft bearings, with each rotor shaft being surrounded, at a location between the shaft bearing and the working space of the compressor rotor, by an annular drain space for removing the escaping lubricant and gas, and by a packing which seals the shaft.

West German Offenlegungschrift No. 24 41 520 discloses a compressor in which the annular drain space forms a part of an expensive packing arrangement of great overall length, intended for taking unfiltered outside air into the working space of the compressor and preventing the lubricant and coolant from escaping from the working space along the shaft. For this purpose, the packing arrangement is composed of further annular spaces, in addition to the drain space, of which one is used as a pressure seal space, that is, pressurized from a compressed gas source, more particularly, from the compressor outlet. The annular drain space is open to the ambient. Thus, the gas passing from the pressure seal space into the drain space is lost. Therefore, such a packing arrangement is usable only if the compressor is enclosed in an airtight manner or if an air pressure shaft is available, because similar losses of another gas, undergoing compression in the compressor, for example, a coolant, would not be acceptable. Even with the compression of air, the losses through the pressure seal chamber must be minimized in order to avoid undue lowering of the efficiency of the compressor. The packing arrangement must, therefore, satisfy high sealing requirements. In practice, this would mean, particularly with higher working pressures of the compressor, the provision of a great overall length of the packing. Packings with a large length, however, require a larger spacing of the bearings which may result in inadmissible deflections and bending stresses in the rotor at relatively small loads.

SUMMARY OF THE INVENTION

The present invention is directed to a compressor of the above-mentioned kind, particularly also usable for compressing coolants, comprising a very simple, inexpensive and space-saving packing arrangement for preventing lubricant and gas from escaping.

Annular drain spaces surrounding each rotor shaft at a location between the shaft bearing and working space for removing escaping lubricant and gas are connected through drain passages to closed collecting chambers which are substantially under the intake pressure of the compressor and wherefrom passageways are provided for returning gas to the intake or the working space of the compressor, and for returning lubricant to the lubrication circuit.

An advantage obtained by the inventive arrangement is that, in addition to preventing any penetration of the bearing lubricant through the drain spaces into the working space of the compressor and, conversely, any penetration of the gas to the bearings, no problems arise with the escaping of lubricant and gas into the drain spaces since these amounts of gas and lubricant are recycled into the compressor or the lubrication circuit. Consequently, relatively large leakages of compressed gas and even injected coolant and lubricant from the working space into the annular drain space can be tolerated. In addition, only a relatively simple, short and inexpensive packing, substantially having to produce merely a throttling effect, is needed between the working space and the drain space.

In one embodiment of the invention, not only the gas, but also the lubricant is recycled from the collecting chambers directly into the intake or the working space of the compressor. To this end, the collecting chambers, or a conduit connecting them to each other, are connected through openings or passages to the intake or working space. The lubricant is entrained by the gas stream through the working space and separated in a separator which is provided at the pressure side of the compressor.

The entrainment of the lubricant by the stream of compressed gas becomes problematic, however, if the gas is of a nature tending to dissolve in the lubricant at higher pressures and thus to lower the viscosity and, thereby, affect the lubricating properties thereof. This is the case with certain coolants, for example, halogenated hydrocarbons. In such applications, in accordance with another advantageous embodiment of the invention, the collecting chambers or the conduit through which the chambers communicate with each other, or both, are connected to a separating tank and the gas space of the tank is connected through a gas line to the intake side of the compressor; the sump of the tank is connected through a lubrication line to the lubricating circuit. In this way, the entire lubricating circuit is completely separated from the stream of compressed gas. Even if gas from the working space leaks into the drain space, it comes into contact with the lubricant only at a low pressure and only a very small proportion thereof is dissolved. Later, in the supply space into which the lubricant is directed, even these small amounts of gas passed into solution have a chance of escaping again from the lubricant.

In accordance with the invention, a second circuit may be provided for a coolant and lubricant which is supplied to the working space of the compressor and separated again from the stream of compressed gas in a separator connected at the pressure side of the compressor. Between this separator and the separating tank of the lubrication circuit, a connecting line may be provided comprising a valve which is controllable by a lever switch of the separating tank.

Thus, it is an object of the present invention to provide an improved rotor compressor, particularly a screw-type compressor, for compressing a gas of the type having a housing including a working space, an intake for passing the gas to be compressed to the working space and a discharge for passing the compressed gas from the working space, two intermeshing rotors mounted on a shaft for rotation in the working space, bearings supporting the shaft at opposite ends, a lubrication circuit for supplying the lubricant to and draining it from the shaft bearings, the housing having an annular drain space surrounding each rotor shaft at a location between the shaft bearing and the working space for removing the escaping lubricant and gas and a packing between the bearings and the working space for sealing the shaft.

In the improved arrangement, according to the invention, the housing includes closed collecting chambers operatively connected to the intake, means for connecting the drain space to the closed collecting chambers which are substantially under the intake pressure of the compressor and return means for returning gas to at least one of the intake and the working space and for returning lubricant to the lubrication circuit. The collecting chambers are preferably disposed adjacent the bearings at the side of the bearings which is remote from the working space in order to collect the lubricant escaping to the side. The return means preferably communicate directly with at least one of the intake and the working space.

It is a further object of the invention to provide an improved rotor compressor, particularly a screw-type compressor, which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
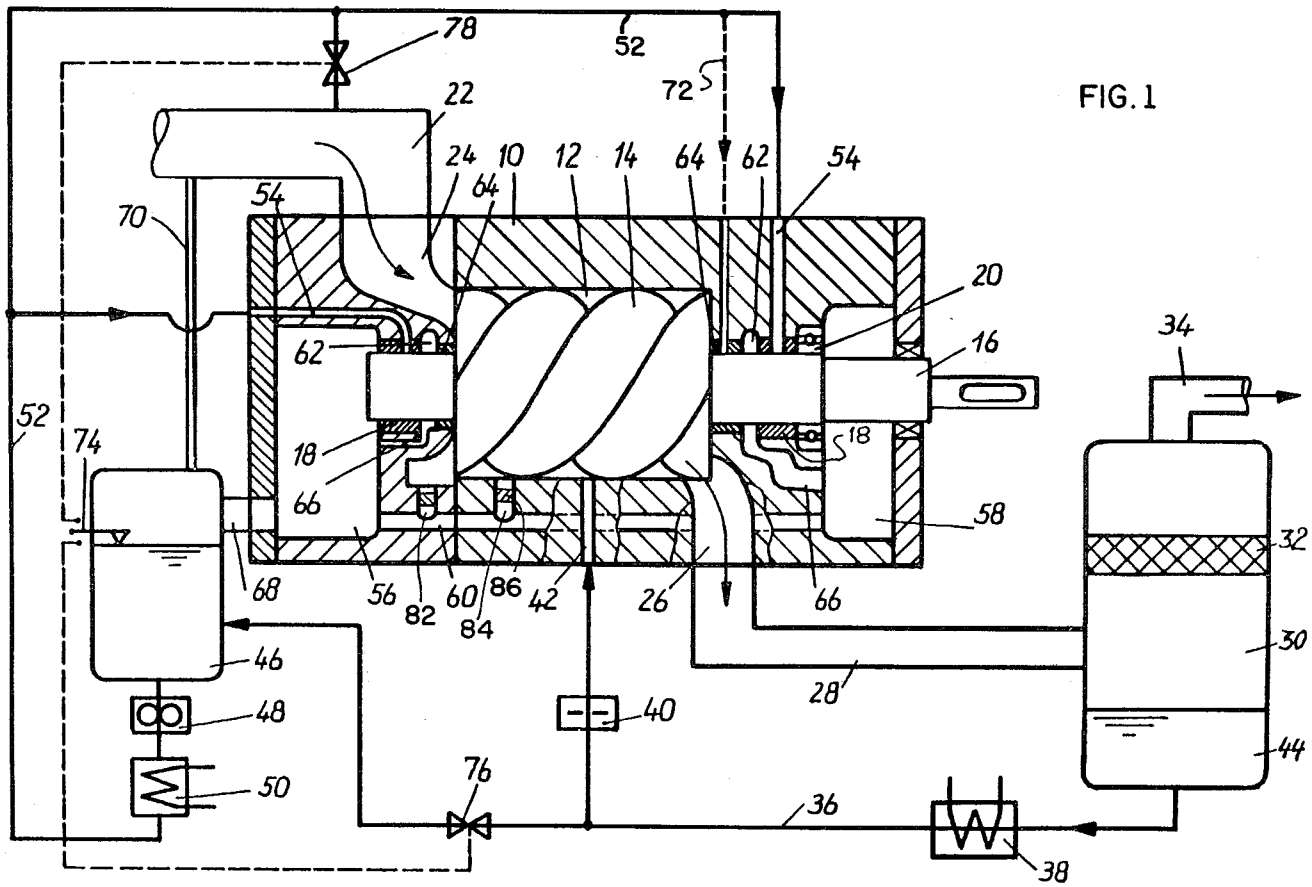
FIG. 1 is a schematic longitudinal sectional view of a screw-type compressor, with a flow diagram of the oil circuit, in accordance with a first embodiment of the invention.

Referring now to the drawings, wherein like reference characters designate like or corresponding parts throughout the views, there is shown an improved rotor compressor in accordance with the invention.

As shown in FIG. 1, the compressor comprises a housing 10 enclosing an elongated cylinder or working space 12 in which two rotors 14, of which only one is shown, are mounted, side-by-side, which engage each other by helically extending ribs and grooves. Shaft 16 of the rotor is supported by either of its ends in radial plane bearings 18 and, in addition, at the pressure side, by means of an axial antifriction bearing 20. Power is supplied only to the shaft of one of the rotors, the main rotor, which is driven by a drive (not shown), and the main rotor, in turn, drives the secondary rotor by a direct meshing engagement, or through a synchronizing gear (not shown). The gas to be compressed, particularly a coolant, such as difluoromonochlormethane, which is such a case is under the evaporator pressure, is drawn in through a suction pipe 22 and an intake connection 24, is compressed in working space 12 by rotors 14, and is delivered through pressure connection 26 and pressure pipe 28, to a gas-lubricant separator or pressure tank 30 serving as a separator and supply tank, wherefrom, the gas passes through a filter 32 and a pipe 34 to the point of utilization, that is, to a condensor, if a coolant is concerned.

In the lower part of pressure tank 30, oil or another liquid suitable for cooling, sealing and lubricating is received, which is supplied through a line 36, a cooler 38, a throttling member 40 and a bore in housing 42, into working space 12 in order to cool the rotors, seal them relative to the housing, and lubricate their working flanks. This oil is then entrained by the compressed gas stream and passes through pressure connection 26 and pressure pipe 28 to tank 30, where it separates from the gas stream and returns to the sump 44.

To lubricate bearings 18, oil from a closed supply tank 46 is delivered by a pump 48 through a cooler 50, a line 52, and passages 54 of the housing, to the oil holes of bearings 18 wherefrom it flows in both axial directions into the bearing gap. A part of the oil passes from the bearing gap directly into oil collecting spaces 56 and 58 which communicate with each other through a longitudinal channel 60 provided in housing 10. The part of the oil flowing in the direction of the working space passes from the respective bearing 18 into an annular oil-collecting groove 62 forming a drain between each of bearings 18 and a sealing element 64 and being each connected through a passage 66 to the associated oil-collecting space 56, 58. Oil collecting space 56 communicates through a drain channel 68 with supply tank 46.

The gas space of supply tank 46 communicates in addition through an equalization line 70 with intake pipe 22. Consequently, supply tank 46, spaces 56, 58 and oil-collecting grooves 62 are under or subjected to the low intake pressure of the compressor. Due to the provision of an oil-collecting groove 62 under low pressure between bearing 18 and working space 12, leakage flow of oil from bearing 18 to working space 12 and vice versa of gas from working space 12 to bearing 18 is effectively prevented. No particularly exacting requirements are therefore imposed on additional sealing elements 64, simple elements of very short extension, such as short labyrinths or floating rings may be satisfactory. These elements may additionally be supplied through corresponding bores in the housing with pressure oil or lubricant as indicated, for example, at 72.

Since supply tank 46 is exposed only to the low intake pressure of the compressor, the oil received therein can dissolve only very small amounts of a soluble gas, for example, the coolant. In tank 30, which is pressurized by the high discharge pressure of the compressor at 20 bar, for example, up to 30% of the coolant may be dissolved at a temperature of 70° C. In supply tank 46, on the other hand, at a pressure of 5 bar, and a temperature of 70° C., the corresponding percentage of dissolved coolant is substantially lower than 5%, so that the oil viscosity is not effected at all.

In the described compressor, oil may leak from the lubricating circuit through the bearings and the working space into the cooling and sealing circuit, or vice versa. Therefore, a mechanism is provided to keep the oil amount in supply tank 46 constant. A level switch 74 having upper and lower limit contacts, controls a solenoid valve 76 which is provided in the connection between line 36 and supply tank 46, and also a solenoid valve 78 which is provided in a connection between line 52 and intake pipe 22 of the compressor. As soon as the oil level in tank 46 drops excessively, which means that too much oil has passed from the low pressure circuit into the high pressure circuit, valve 76 opens and oil can flow from pressure tank 30 into tank 46. If the rise of the oil level in tank 46 is excessive, valve 78 opens and the oil in excess passes from tank 46 into the intake pipe and therefrom with the gas through the compressor into supply tank 30.

Figure 2:
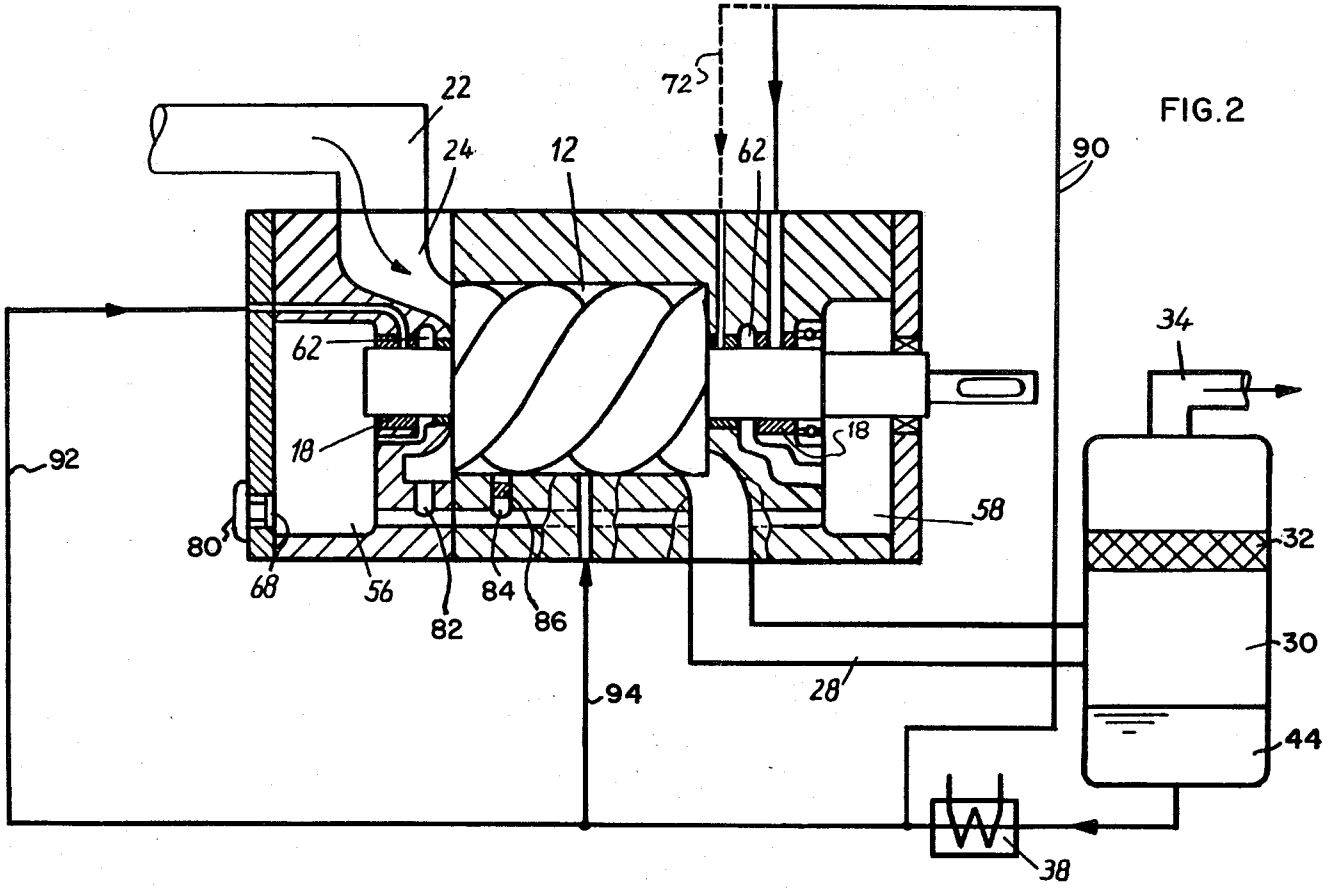
FIG. 2 is a view similar to FIG. 1 showing a second embodiment of the invention with a simplified oil circuit.

FIG. 2 shows a simplified embodiment to be used in instances where, due to low working pressures or to handling of gases which are not soluble in oil, there is no risk of lowering the oil viscosity by dissolved gas. The construction of the compressor, per se, according to FIG. 1 may remain unchanged. Supply tank 46 shown in FIG. 1, and the associated lines, are omitted and the no longer needed outlet 68 from oil-connecting space 56 is closed with a plug 80. Instead, selectively one of bores 82, 84, which have been provided in the embodiment of FIG. 1 as connections between longitudinal channel 60 and, respectively, intake connection 24 and working space 12 of the compressor, and of which the respective other one or, in the embodiment of FIG. 1, even both, are closed with suitable plugs 86, is unplugged. The entire amount of the lubricating oil now passes from bearings 18 through the respective open bore 82 or 84 into the compression space from where it is taken along by the compressed gas through pressure line 28 to be separated in supply tank 30.

From oil sump 44, the oil is directed as lubricant through lines 90, 92 to bearings 18, and through line 94 into the compression space to lubricate and cool the rotor flanks. This embodiment has the substantial advantage, due to the oil-collecting grooves or drain spaces 62, that no separate pump for supplying the lubricant is needed. Since the spaces 62, 56, 58, adjacent to bearings 18 are continuously under the pressure of the intake side of the compressor, the differential pressure resulting therefrom between pressure tank 30 and the locations of oil injection or lubrication is quite sufficient for supplying the compressor with oil, without running the risk, in view of the relatively low lubrication pressure, that gas would penetrate to the bearings. As already mentioned, this is particularly important in compressors for refrigerants because such compressors always operate in closed circuits in which leakage of both sealing substances from the outside inwardly and the coolant from the inside outwardly would unfavorably affect the entire function in a proportion increasing with the duration of the operation.

While specific embodiments of the invention have been shown and described in detail to illustrate the application of the principles of the invention, it will be understood that the invention may be embodied otherwise without departing from such principles.

What is claimed is:

1. A rotary compressor comprising:

a housing defining a working space with an intake for receiving gas at low pressure to be compressed, a discharge for discharging compressed gas at high pressure and at least two oil spaces;

at least one rotor having a shaft rotatably mounted in said working space for compressing gas in said working space;

a radial plane bearing adjacent each oil space connected between each end of said shaft and said housing for rotatably mounting said rotor;

a shaft packing surrounding said shaft between each of said bearings and said working space;

a lubricating oil circuit including, an oil supply tank defining a tank space for receiving oil and gas, a supply conduit for supplying oil from said tank space to each bearing, and a return conduit for returning oil from said oil spaces to said tank space;

a pressure equalizing connection connected between said lubricating oil circuit and said low pressure intake to equalize the pressure of all of said oil lubricating circuit with pressure in said intake;

said housing defining a drain space surrounding said shaft and between said packing and said bearing at each end of said shaft for collecting oil flowing out from each bearing on one side of each drain space and gas flowing through each packing from said working space on opposite side of each drain space;

a drain channel connected respectively between each drain space and each oil space; and an oil space conduit connected between said two oil spaces.

2. A rotary compressor according to claim 1, wherein said equalizing connection leads from each drain space through each drain channel, each associated oil space, connected supply and return conduits, said oil space connection and said tank space, said tank space being closed and said equalizing section including an equalizing line connected between said housing intake and said closed tank space.

3. A rotary compressor according to claim 1, wherein said housing includes at least one port connected between said working space and at least one of said oil spaces and oil space conduit, said at least one port and said return conduit being selectively closable for selectively bypassing oil flow to said oil supply tank and from said working space.

4. A rotary compressor according to claim 1, including an additional oil circuit for supplying cooling and sealing fluid to said working space, said additional oil circuit comprising a separator tank for separating lubricant entrained by a gas stream in said additional oil circuit from gas therein, said housing discharge connected to said separator tank, and a connecting line connected between said separator tank and said oil supply tank with a valve in said connecting line and a level switch associated with said oil supply tank connected to said valve for regulating said valve in accordance with a level of oil in said oil supply tank.

5. An improved rotor compressor, particularly a screw-type compressor, for compressing a gas and of the type having a housing including a working space, an intake for passing gas to be compressed to the working space and a discharge for passing the compressed gas from the working space, two intermeshing rotors mounted on a shaft for rotation in the working space, bearings supporting the shafts at opposite ends, a lubrication circuit for supplying the lubricant to and draining it from the shaft bearings, the housing having an annular drain space surrounding each rotor shaft at a location between the shaft bearing and the working space for removing the escaping lubricant and gas, and a packing between the bearings and the working space for sealing the shaft, the improvement wherein, the housing includes closed collecting chambers operative connected to the intake, means for connecting the drain space to said closed collecting chambers which are substantially under the intake pressure of the compressor, and return means for returning gas to at least one of the intake and the working space and for returning lubricant to the lubrication circuit, said return means including a supply tank adapted to contain a supply of lubricant for lubricating the bearings, said supply tank being a closed tank enclosing a compartment defining a gas space and a liquid space adapted to contain gas and lubricant, means for establishing fluid communciation between said gas space and the intake, a drain conduit connecting said liquid space to the lubrication circuit, and a conduit connecting said collecting chambers to said supply tank, a separating tank connected to the discharge for separating lubricant entrained in the compressed gas, a connecting conduit interconnecting said separating tank and said supply tank, a valve in said connecting conduit operable to open and close a fluid communication path through said connecting conduit, and sensing means in said supply tank operatively connected to said valve for operating said valve to open and close the fluid communication path responsive to a fluid level in said supply tank.

6. The improved rotor compressor, as set forth in claim 5, wherein said collecting chambers are disposed adjacent the bearings at the side of the bearings which is remote from the working space in order to collect the lubricant escaping to the side.

7. The improved rotor compressor, as set forth in claim 5, wherein said return means communicate directly with said at least one of the intake and the working space.

8. The improved rotor compressor, as set forth in claim 5, further comprising a lubrication line interconnecting said separating tank and the working space for fluid communication.

9. An improved screw compressor, on the type in which a housing has a working space, an intake for passing a gas to the working space and a discharge for passing the gas from the working space, two intermeshing rotors rotatably mounted in the working space for compressing the gas, and bearings mounted at the intake and discharge for supporting the rotors; a lubrication circuit having a supply tank adopted to contain a supply of lubricant for lubricating the bearings, a supply conduit establishing fluid communication between the bearings and the supply tank, chambers for collecting lubricant supplied to the bearings and a return conduit establishing fluid communication between the chambers and the supply tank; and a cooling and sealing circuit having means operatively connected to the discharge for supplying a coolant and sealant under the discharge pressure of the compressor from the working space, and separator means connected to the discharge for separating coolant and sealant from the discharged gas, the improvement wherein, the supply tank is a closed tank enclosing a compartment defining a gas space and a liquid space adopted to contain gas and lubricant, and further comprising means establishing fluid communication between said gas space and said intake for equalizing the pressure therebetween, the lubricant, coolant and sealant being the same substance, and further comprising a first connecting line connecting the lubrication circuit to the coolant and sealing circuit, a valve in said first connecting line operable to open and close a fluid communication path through said first connecting line responsive to the fluid level in the supply tank, and sensing means for operating said valve responsive to the fluid level in the sensing tank.

10. In an improved screw compressor, the improvement set forth in claim 9, further comprising a second connecting line connecting the intake and said means establishing fluid communication between said gas space and said intake, and a valve operable to open and close a fluid path through said second connecting line responsive to the fluid level in the supply tank, said last mentioned valve being operatively connected to said sensing means.

* * * * *